US009032850B2

(12) United States Patent
Chiba et al.

(10) Patent No.: US 9,032,850 B2
(45) Date of Patent: May 19, 2015

(54) ROTARY CUTTER UNIT AND PRINTER DEVICE HAVING THE UNIT

(75) Inventors: Masafumi Chiba, Shinagawa (JP); Yukihiro Mori, Shinagawa (JP); Yoshinari Takabatake, Shinagawa (JP); Masahiro Tsuchiya, Shinagawa (JP); Kunihiko Funada, Shinagawa (JP); Yoichi Takamura, Shinagawa (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 480 days.

(21) Appl. No.: 12/314,616

(22) Filed: Dec. 12, 2008

(65) Prior Publication Data

US 2009/0151526 A1 Jun. 18, 2009

(30) Foreign Application Priority Data

Dec. 14, 2007 (JP) ..... 2007-323458

(51) Int. Cl.

| | |
|---|---|
| ***B26D 1/40*** | (2006.01) |
| ***B26D 5/02*** | (2006.01) |
| ***B26D 1/38*** | (2006.01) |
| *B26D 5/00* | (2006.01) |
| *B26D 5/20* | (2006.01) |

(52) U.S. Cl.

CPC *B26D 5/02* (2013.01); *B26D 1/385* (2013.01); *B26D 5/00* (2013.01); *B26D 5/20* (2013.01)

(58) Field of Classification Search

USPC ..... 83/608–610, 74, 343

See application file for complete search history.

(56) References Cited

U.S. PATENT DOCUMENTS

| | | | | | |
|---|---|---|---|---|---|
| 2,432,497 | A | * | 12/1947 | Behrens | 83/298 |
| 3,925,786 | A | | 12/1975 | Haas | |
| 4,184,619 | A | * | 1/1980 | Stewart et al. | 225/94 |
| 4,297,930 | A | * | 11/1981 | Putzke | 83/156 |
| 4,949,606 | A | * | 8/1990 | Pfeiffer | 83/69 |
| 5,000,069 | A | | 3/1991 | Knobel | |

(Continued)

FOREIGN PATENT DOCUMENTS

| | | |
|---|---|---|
| JP | 51-122882 | 10/1976 |
| JP | 56-166084 | 12/1981 |

(Continued)

OTHER PUBLICATIONS

European Search Report issued on Mar. 9, 2009 in corresponding European Patent Application 08105901.6.

(Continued)

*Primary Examiner* — Kenneth E Peterson

(74) *Attorney, Agent, or Firm* — Staas & Halsey LLP

(57) ABSTRACT

A simple and compact rotary cutter unit capable of detecting a home position of a rotary cutter, and a printer device having the rotary cutter unit. A radially outwardly extending fin-shaped detected member is arranged on an end portion of the rotating blade opposed to a second gear of the rotating blade. A photosensor is arranged within a main frame of the printer device so that the photosensor may detect the fin-shaped member when the rotating blade is positioned at the home position. The fin-shaped member and the photosensor are not positioned outside relative to both ends of the rotating blade in relation to the direction of the rotational axis of the rotating blade. Therefore, it is not necessary to increase the width of the printer device due to the presence of the fin-shaped member or the photosensor, whereby the printer device may be compactly constituted.

6 Claims, 7 Drawing Sheets

(56) References Cited

U.S. PATENT DOCUMENTS

| | | | | | |
|---|---|---|---|---|---|
| 5,001,953 | A | * | 3/1991 | Pfeiffer | 83/342 |
| 5,765,460 | A | * | 6/1998 | Wathieu | 83/37 |
| 6,089,957 | A | * | 7/2000 | Shibata | 451/41 |
| 6,095,399 | A | * | 8/2000 | Takada | 228/44.7 |
| 6,145,423 | A | * | 11/2000 | Boreali et al. | 83/145 |

FOREIGN PATENT DOCUMENTS

| | | |
|---|---|---|
| JP | 61-5593 | 1/1986 |
| JP | 02-167696 | 6/1990 |
| JP | 04-069191 | 3/1992 |
| JP | 7-1272 | 1/1995 |
| JP | 11-005338 | 1/1999 |
| JP | 2005-046925 | 2/2005 |
| JP | 2006-159665 | 6/2006 |

OTHER PUBLICATIONS

European Search Report dated May 27, 2011 in corresponding European Patent Application 10162651.3.

Japanese Office Action issued Apr. 10, 2012 in corresponding Japanese Patent Application No. 2007-323458 (3 pages) (4 pages English translation).

* cited by examiner

ROTARY CUTTER UNIT AND PRINTER DEVICE HAVING THE UNIT

RELATED APPLICATIONS

The present application claims priority from Japanese Patent Application No. 2007-323458, filed on Dec. 14, 2007, the entire content of which is fully incorporated herein by reference.

BACKGROUND OF THE INVENTION

1. Field of the Invention

The present invention relates to a rotary cutter unit having a mechanism for detecting a waiting position of the unit, and a printer device having the rotary cutter unit.

2. Description of the Related Art

In a conventional printer, printing paper unwound from a roll of paper is nipped between a platen roller and a thermal head, and printing is carried out by heating the thermal head during the feeding of the paper. In some printers, a cutter having a V-shaped blade or a spiral blade is provided for cutting printing paper after printing. When a rotary cutter, having a spiral blade formed on a cylindrical rotating body, is arranged in a printer, the printer may be more compact than a printer having another type of cutter such as the V-shaped cutter. For example, Japanese Unexamined Patent Publication (Kokai) No. 2-167696 discloses a control device for cutting a sheet, having a detecting member 9 attached to the side of a knife rotor 4 and a detection sensor 10 capable of transmitting a stop command when detecting member 9 is positioned where the detecting member cannot be detected during deceleration, so that knife 8 does not stop at a position where the knife can cut a sheet.

Japanese Examined Utility Model Publication (Kokoku) No. 7-1272 discloses a rotary cutter device, in which a disk 5 having a notch 5*a* formed thereon is attached to a rotation shaft of a rotating blade 1 and a photosensor 6 detects the position of notch 5*a*, whereby rotating blade 1 may be stopped at a rotational position within a predetermined range.

In a rotary cutter having a fixed blade and a rotating blade, when the blades contact each other or are positioned close to each other, it is difficult to smoothly insert printing paper between the blades, which may result in a paper jam. Therefore, when the rotating blade is stopped, it is necessary to control the stopping position of the rotating blade so that an edge of the rotating blade is away from the fixed blade by a certain distance (in other words, the rotating blade is positioned at a waiting position, a so-called "a home position"). In both Japanese Unexamined Patent Publication (Kokai) No. 2-167696 and Japanese Examined Utility Model Publication (Kokoku) No. 7-1272, it is possible to stop the rotating blade at the home position. However in recent years, a more compact printer, having a function for detecting the rotational position of the rotating blade has been desirable.

For example, in the printer of Japanese Examined Utility Model Publication (Kokoku) No. 7-1272, disk 5 and photosensor 6 for detecting the rotational position of rotating blade 1 are arranged outside of rotating blade 1 in relation to the axial direction of the rotating blade, and therefore the printer inevitably has a wide width due to the volumes of disk 5*a* and photosensor 6.

SUMMARY OF THE INVENTION

Accordingly, an object of the present invention is to provide a rotary cutter unit having a compact mechanism for detecting the home position thereof, and a printer device having the rotary cutter unit.

According to one aspect of the present invention, there is provided a rotary cutter unit comprising: a rotating blade having a cylindrical body configured to rotate about a center axis and an edge formed on the cylindrical body; a detected part formed near one end portion of the rotating blade in the direction of the center axis of the rotating blade; and a detecting part for detecting the detected part, wherein both the detected part and the detecting part are positioned inside of the both ends of the rotating blade in relation to the direction of the center axis of the rotating blade.

The detected part is a fin-shaped member formed on one end portion of the rotating blade, the fin-shaped member radially outwardly extending from the one end portion, and the detecting part is a transmissive photosensor capable of receiving the fin-shaped member. In this case, the rotating blade may have a gear for driving the rotating blade at one end portion thereof, and the detected part may be a fin-shaped member formed on the other end portion of the rotating blade opposed to the gear. Alternatively, the rotating blade may be a gear for driving the rotating blade at one end portion thereof, and the detected part may be a fin-shaped member formed on a shaft portion of the gear.

The detected part is a mark formed on a side surface of the rotating blade, the mark having a color different from a color of the side surface of the rotating blade, and the detecting part is a reflective photosensor capable of discriminating the mark from the side surface of the rotating blade other than the mark.

The detected part is a fin-shaped member formed on one end portion of the rotating blade, the fin-shaped member radially outwardly extending from the one end portion, and the detecting part is a mechanical switch having a movable portion configured to be displaced when contacting the fin-shaped member. In this case, the rotating blade may have a gear for driving the rotating blade at one end portion thereof, and the detected part may be a fin-shaped member formed on the other end portion of the rotating blade opposed to the gear. Alternatively, the rotating blade may have a gear for driving the rotating blade at one end portion thereof, and the detected part may be a fin-shaped member formed on a shaft portion of the gear.

The detected part is a member having generally D-shape formed by removing a part of a circular shape, and the detecting part is a mechanical switch having a movable portion configured to be displaced when contacting an arc portion of the D-shaped member.

According to another aspect of the present invention, there is provided a printer device comprising the rotary cutter unit of the invention.

BRIEF DESCRIPTION OF THE DRAWINGS

The above and other objects, features and advantages of the present invention will be made more apparent by the following description of the preferred embodiments thereof, with reference to the accompanying drawings, wherein.

DETAILED DESCRIPTION

Figure 1A:
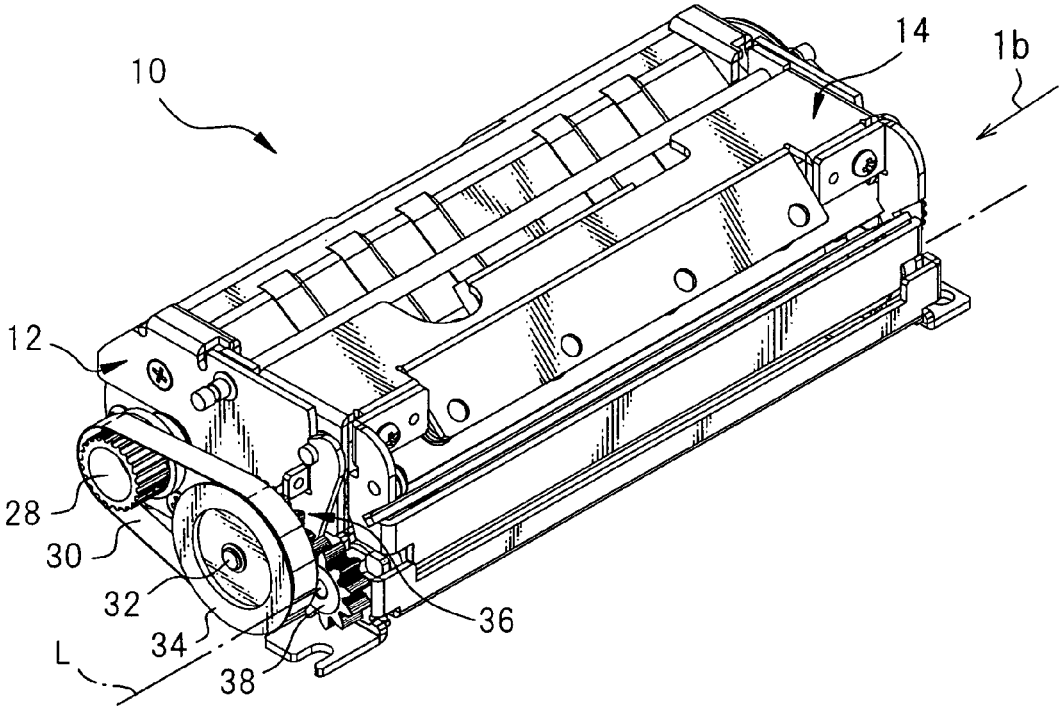
FIG. 1*a* is a perspective view of a printer device having a rotary cutter unit of the invention when a head module thereof is assembled.
Figure 1B:
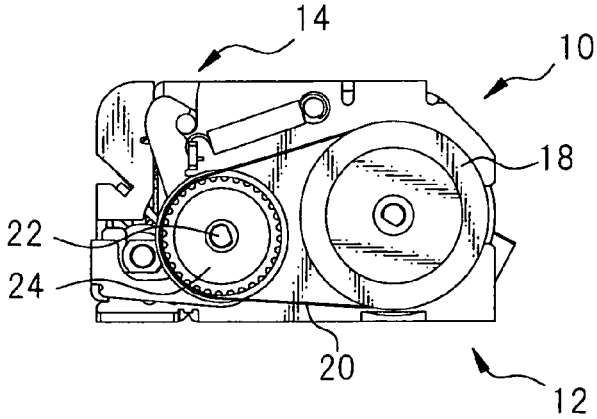
FIG. 1*b* is a side view viewed in the direction of an arrow 1*b* of FIG. 1*a;*
Figure 2A:
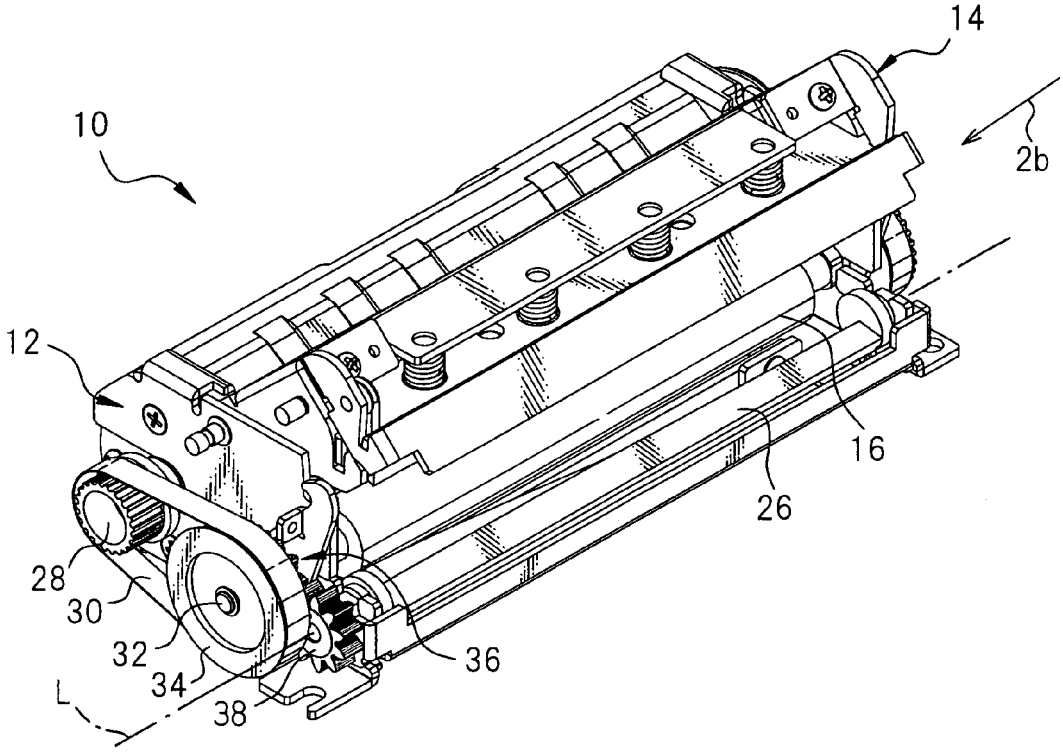
FIG. 2*a* is a perspective view of the printer device having the rotary cutter unit of the invention when the head module thereof is detached.

FIG. 1*a* is a perspective view of a thermal printer device 10 according to a preferable embodiment of the invention. Thermal printer 10 has a main frame 12 and a head module 14 configured to detachably attached to main frame 12, as shown in FIG. 2*a*. A platen roller (hereinafter, referred to as "platen") 16 having a rubber roller is contained in main frame 12, and platen 16 is rotatably driven by a pulse motor (not shown). Output power of the pulse motor is transmitted to platen 16 via a first pulley 18 (see FIG. 2*b*) coupled to an output shaft of the pulse motor, a first timing belt 20, and a second pulley 24 attached to a first shaft portion 22 of platen 16.

Figure 2B:
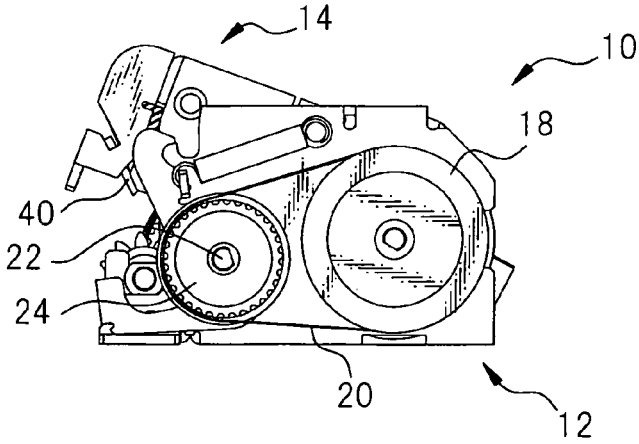
FIG. 2*b* is a side view viewed in the direction of an arrow 2*b* of FIG. 2*a;*

As shown in FIG. 2*a*, a rotating blade 26 of a rotary cutter unit for cutting printing paper (not shown) is contained in main frame 12, and rotating blade 26 is rotatably driven about a center axis L by means of a pulse motor (not shown). Output power of the pulse motor is transmitted to rotating blade 26 via a third pulley 28 coupled to an output shaft of the pulse motor, a second timing belt 30, a fourth pulley 34 attached to a second shaft portion 32 of platen 16, a first gear 36 formed integrally with fourth pulley 34, and a second gear 38 engaged with first gear 36. Rotating blade 26 can cut printing paper (not shown) in cooperation with a fixed blade 40 (as shown in FIG. 2*b*) fixed to head module 14. However, an application of the rotary cutter unit of the present invention is not limited to such a printer device having a module-type thermal head.

Figure 3:
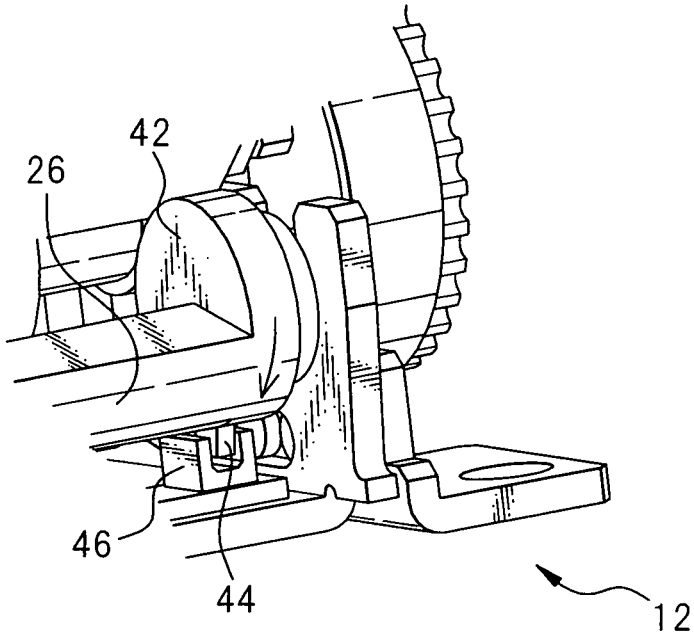
FIG. 3 is an enlarged view of a rotary cutter unit according to a first embodiment of the invention.

FIG. 3 is an enlarged view of a part "A" of FIG. 2*a* showing a first embodiment of the rotary cutter unit of the invention. A fin-shaped detected member 44, radially outwardly extending from an end portion 42 opposed to second gear 38 of rotating blade 26, is arranged. Within main frame 12, a detecting part or a photosensor 46 is arranged for detecting fin-shaped member 44 when rotating blade 26 is positioned at "a home position" (FIG. 3). In particular, photosensor 46 is a transmissive-type photosensor having an U-shaped recess, configured so that detected member 44 is positioned in the recess when the rotating blade is at the home position. As shown, fin-shaped member 44 and photosensor 46 are not positioned outside (in FIG. 3, the right side) of end portion 42 of rotating 26 in relation to the direction of the rotational axis (or the center axis) L of the rotating member. Therefore, the width of main frame 12 is not increased due to the volumes of fin-shaped member 44 and photosensor 46, whereby the printer device may be compact.

Figure 4:
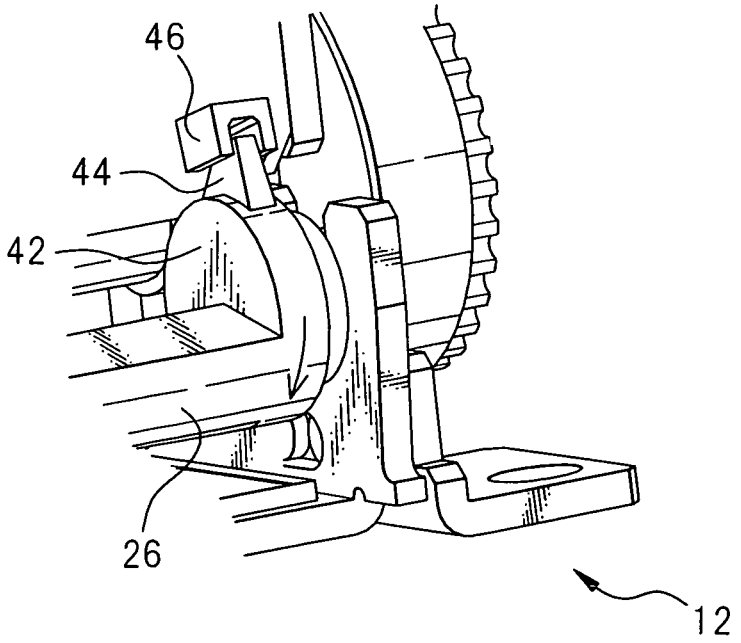
FIG. 4 is an enlarged view of a modification of the rotary cutter unit according to the first embodiment.

FIG. 4 shows a modification of the constitution of FIG. 3. The constitution of FIG. 4 is different from that of FIG. 3 in that photosensor 46 is positioned above rotating blade 26. As shown in FIG. 4, it is not necessary to position photosensor 46 at the lower part of main frame 12. In other words, the position of photosensor may be properly determined in view of the location of the other components within the main frame.

Figure 5:
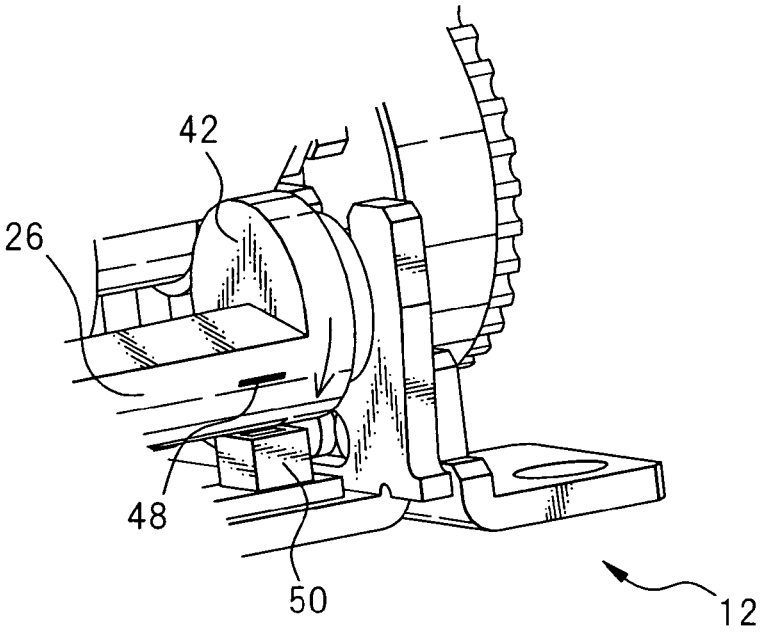
FIG. 5 is an enlarged view of a rotary cutter unit according to a second embodiment of the invention.

FIG. 5 shows a second embodiment of the rotary cutter unit of the invention. In the second embodiment, a mark 48 as a detected part is arranged on the lateral side of rotating blade 26, instead of fin-shaped member 44 of the first embodiment. Further, the second embodiment uses a reflective-type photosensor 50 instead of transmissive photosensor 46 of the first embodiment. In particular, mark 48 is a mark having an arbitrary shape such as a line, a circle or a polygon, the color of which (for example, black or dark color) is different from the color of a part of the side of rotating blade 26 other than the mark. Reflective photosensor 50 is positioned at a place where the photosensor can detect mark 48 when rotating blade 26 is positioned at the home position. When photosensor 50 faces mark 48, a light from the photosensor and reflected by the mark is weak in comparison to when photosensor 50 faces a part of rotating blade (generally having metallic or light color) other than the mark, whereby the photosensor may detect whether rotating blade 26 is positioned at the home position or not. In the second embodiment, mark 48 has not the volume substantially and reflective photosensor 50 is not positioned outside of end portion 42 of rotating blade 26. Therefore, the printer device may be compact.

Figure 6:
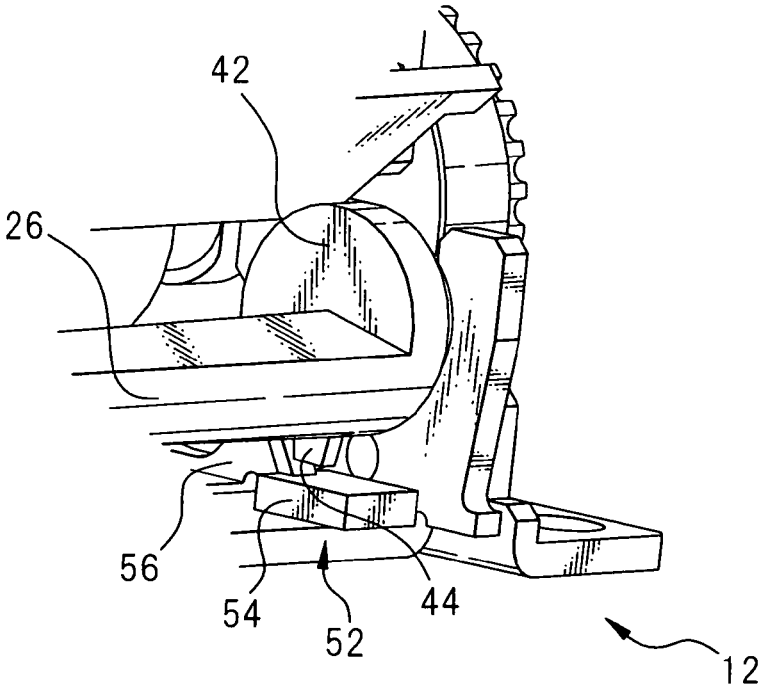
FIG. 6 is an enlarged view of a rotary cutter unit according to a third embodiment of the invention.

FIG. 6 shows a third embodiment of the rotary cutter unit of the invention. In the third embodiment, photosensor 46 of the first embodiment is replaced with a mechanical switch 52. Mechanical switch 52 has a body 54 and a knob 56 pivotably mounted on body 54. Knob 54 is upwardly biased and configured to be pushed down by contacting fin-shaped member 44 formed on end portion 42 of rotating blade 26. By arranging mechanical switch 52 at a position where knob 56 of switch 52 is pushed down by fin-shaped member 44 when rotating blade 26 is positioned at the home position, it can be detected as to whether rotating blade 26 is positioned at the home position or not.

Figure 7:
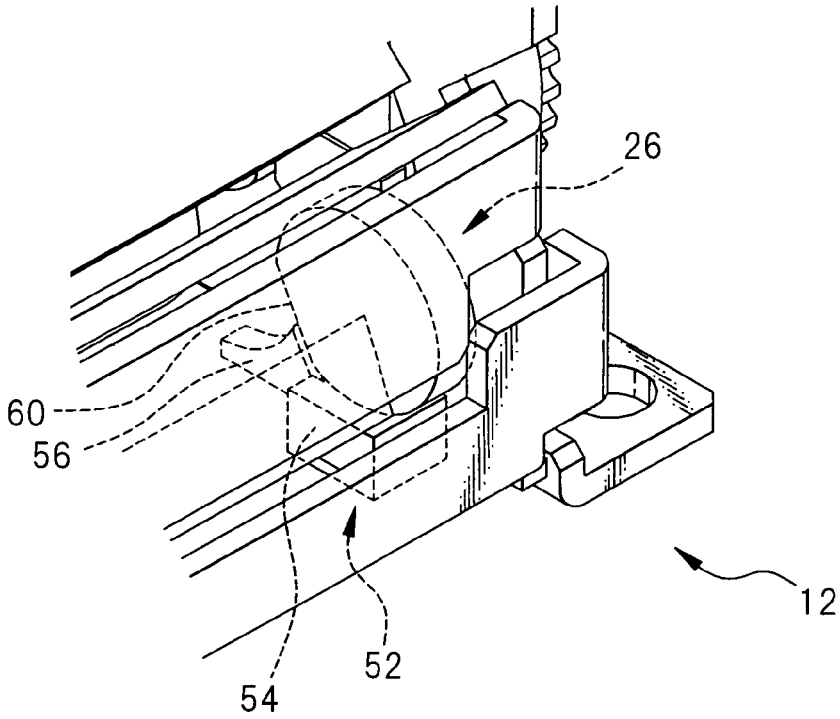
FIG. 7 is an enlarged view of a rotary cutter unit according to a fourth embodiment of the invention.
Figure 8A:
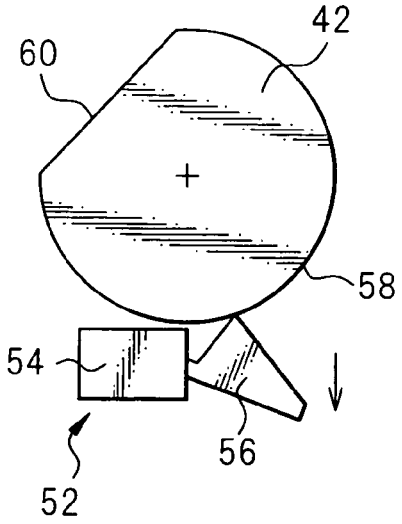
FIG. 8*a* is a schematic side view of the fourth embodiment in which an arc portion of a rotating blade contacts a knob of a mechanical switch.
Figure 8B:
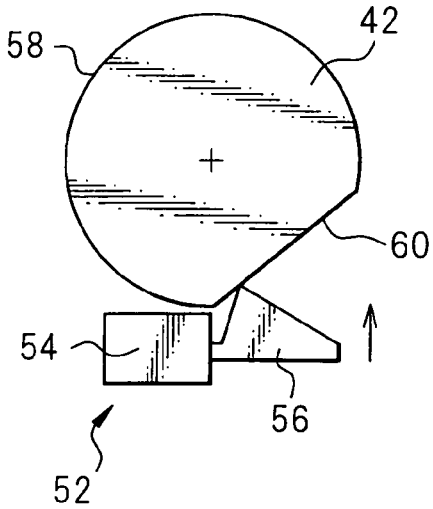
FIG. 8*b* is a schematic side view of the fourth embodiment in which a chord portion of a rotating blade contacts or is adjacent to a knob of a mechanical switch.

FIG. 7 shows a fourth embodiment of the rotary cutter unit of the invention. In the fourth embodiment, although a mechanical switch similar to mechanical switch 52 of the third embodiment is used, rotating blade 26, a part of which is removed, is used as the detected part, instead of the fin-shaped member. In particular, a part of end portion 42 of rotating blade 26 is removed or cut off, so as to form a generally D-shaped portion viewed in the axial direction of the rotating blade. Mechanical switch 52 is arranged so that knob 56 is pushed down by an arc 58 of the D-shaped portion as shown in FIG. 8*a*, and knob 56 is not pushed down by a chord 60 of the D-shaped portion as shown in FIG. 8*b*. By arranging rotating blade 26 and mechanical switch 52 so that the positional relationship as shown in FIG. 8*b* is realized when rotating blade 26 is positioned at the home position, it can be detected as to whether rotating blade 26 is positioned at the home position or not.

Figure 9:
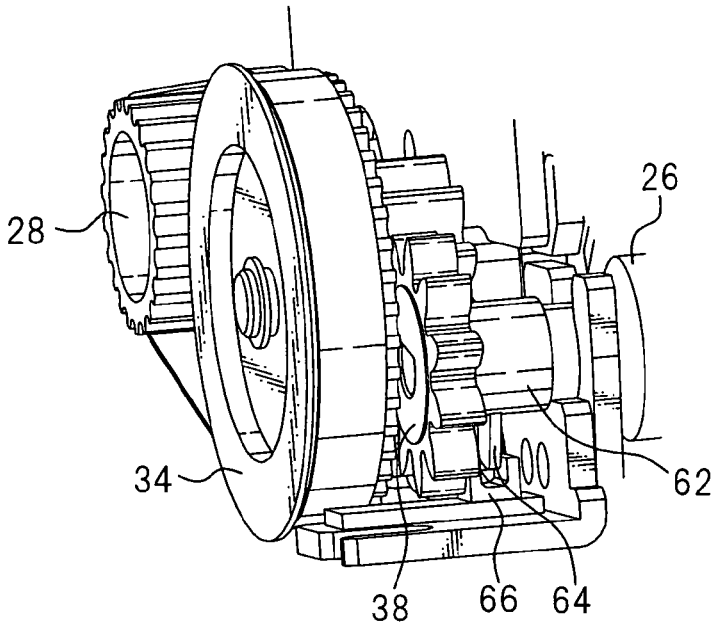
FIG. 9 is an enlarged view of a rotary cutter unit according to a fifth embodiment of the invention.
Figure 10:
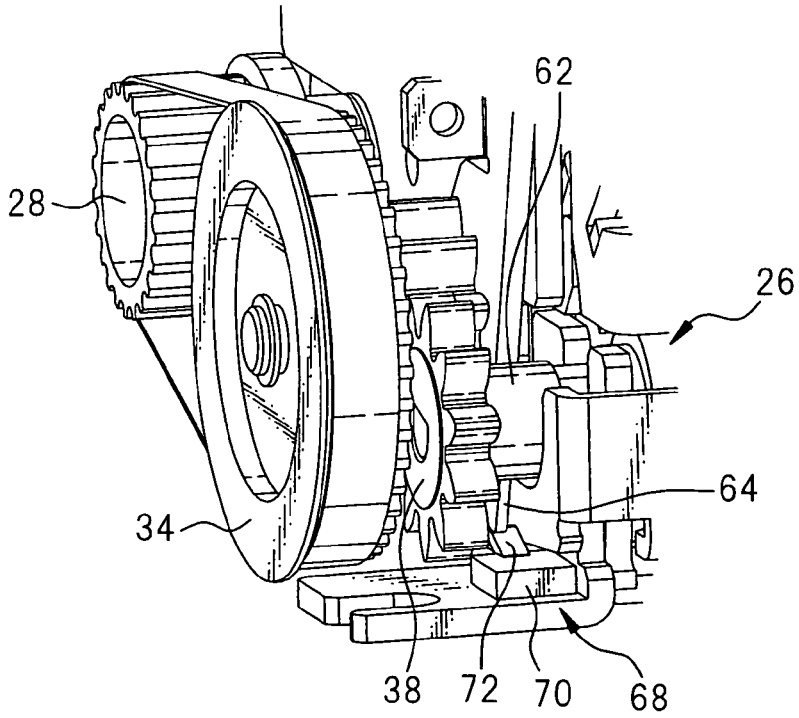
FIG. 10 is an enlarged view of a rotary cutter unit according to a sixth embodiment of the invention.
Figure 11:
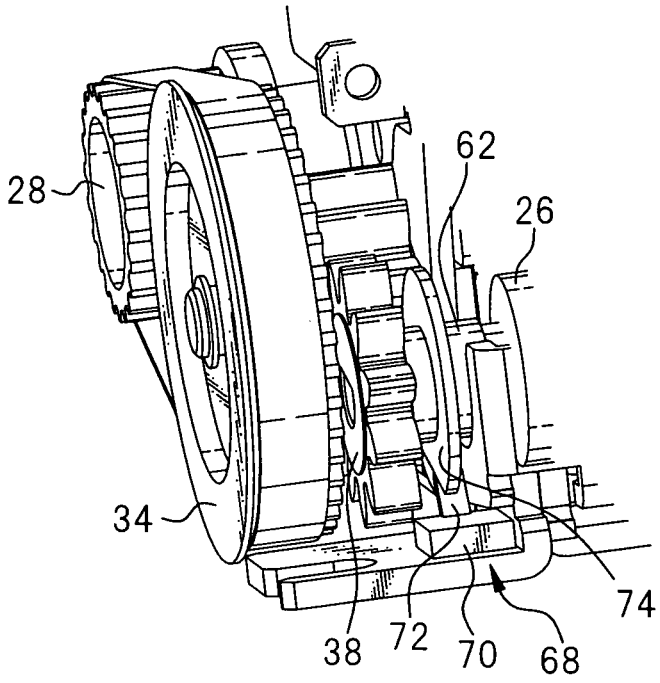
FIG. 11 is an enlarged view of a rotary cutter unit according to a seventh embodiment of the invention.

In the embodiments as shown in FIGS. 3 to 8*b*, a mechanism for detecting the waiting position or the home position of rotating blade 26 is positioned near end portion 42 opposed to second gear 38 fixed to the rotating blade. However, as shown in FIGS. 9 to 11 below, the mechanism for detection may be positioned near second gear 38. First, in a fifth embodiment as shown in FIG. 9, a fin-shaped detected member 64, similar to fin-shaped member 44 of the first embodiment, is arranged on a gear shaft 62 of rotating blade 26. As shown, gear shaft 62 is positioned inside relative to second gear 38 in the direction of the rotational axis of rotating blade 26. Further, a transmissive-type photosensor 66, similar to transmissive photosensor 46 of the first embodiment, is arranged for detecting detected member 64. Since the thickness (or the dimension in the axial direction of rotating blade 26) of fin-shaped member 64 may be small, it is not necessary to increase the length of gear shaft 62 due to the presence of member 64 on gear shaft 62. Therefore, the printer device may be compact.

FIG. 10 shows a sixth embodiment of the rotary cutter unit of the invention, similar to the third embodiment as shown in FIG. 3. In the sixth embodiment, photosensor 66 of the fifth embodiment is replaced with a mechanical switch 68. Mechanical switch 68 has a body 70 and a knob 72 pivotably mounted on body 70. Knob 72 is upwardly biased and configured to be pushed down by contacting fin-shaped member 64 formed on gear shaft 62 of rotating blade 26. By arranging mechanical switch 68 at a position where knob 72 of switch 68 is pushed down by fin-shaped member 64 when rotating blade 26 is positioned at the home position, it can be detected as to whether rotating blade 26 is positioned at the home position or not.

FIG. 11 shows a seventh embodiment of the rotary cutter unit of the invention. In the seventh embodiment, although a mechanical switch 68 similar to mechanical switch 52 of the third embodiment is used, a disk 74 fixed to gear shaft 62 is used as the detected part, instead of the fin-shaped member. In particular, disk 74 is a circular disk, a part of which is removed or cut off, so as to form a generally D-shaped thin plate. The seventh embodiment uses a feature generally the same as the fourth embodiment of FIG. 8. In other words, mechanical switch 68 is arranged so that knob 72 of the switch is pushed down by an arc of the D-shaped plate, and knob 72 is not pushed down by a chord of the D-shaped plate. By arranging rotating blade 26 and mechanical switch 68 so that the chord the D-shaped portion is positioned close to knob 72 when rotating blade 26 is positioned at the home position, it can be detected as to whether rotating blade 26 is positioned at the home position or not.

As described above, in the rotary cutter unit according to the present invention, both the detected part such as the fin-shaped member and the detecting part such as the photosensor are positioned inside relative to both end portion of the rotating blade having the second gear, in relation to the direction of the center axis of the rotating blade. Therefore, it is not necessary to increase the width of the printer device in order to provide the mechanism for detecting the home position of the rotating blade, whereby the printer device may be compactly constituted.

The fin-shaped member extending radially outwardly from one end portion of the rotating blade and a transmissive photosensor capable of receiving the fin-shaped member may realize a preferred embodiment for the detected part and the detecting part.

When a mark applied to the lateral side of the rotating blade and a reflective photosensor capable of discriminating the mark from a part on the lateral side other than the mark, a more compact printer device may be provided since the mark does not substantially have the volume.

The fin-shaped member extending radially outwardly from one end portion of the rotating blade and a mechanical switch capable of being displaced by contacting the fin-shaped member may realize a preferred embodiment for the detected part and the detecting part.

One end portion of the rotating blade having generally D-shape formed by removing a part of a circular shape and a mechanical switch capable of being displaced by contacting an arc of the D-shaped portion may realize a preferred embodiment for the detected part and the detecting part.

When a gear is provided to the rotating blade to rotate or drive the rotating blade, the detected part may be positioned on a gear shaft of the gear or the end of the rotating blade opposed to the gear. In both cases, the printer device may be compact.

While the invention has been described with reference to specific embodiments chosen for the purpose of illustration, it should be apparent that numerous modifications could be made thereto, by one skilled in the art, without departing from the basic concept and scope of the invention.

The invention claimed is:

1. A rotary cutter unit for cutting printing paper, containable in a printing device, the rotary cutter unit comprising:

a frame;

a platen roller rotatably supported by the frame;

a rotating blade extending axially as an axial blade having a rotating body, the rotating body for the rotating axial blade has end portions and a partial cylindrical surface with an edge as the axial blade formed between the end portions to accommodate forming a detected part on the rotating body for the rotating axial blade, the rotating body for the rotating axial blade positioned inside of the frame and supported by the frame in a manner rotatable about a center axis;

a detecting part for detecting the detected part;

a motor for rotating the rotating body and the platen roller; and a first transmission portion provided on one end of the center axis of the rotating body for transmitting rotating force of the motor to the rotating body, the first transmission portion positioned outside of the frame where the rotating axial blade is supported, and a second transmission portion for transmitting rotating force of the motor to the platen roller, the second transmission portion being positioned outside of the frame on a side of the frame opposite of where the first transmission portion is provided, wherein the partial cylindrical surface of the rotating body for the rotating axial blade accommodates positioning both the detected part formed on the rotating body for the rotating axial blade and the detecting part inside of the frame supporting the rotating body for the rotating axial blade, wherein the detected part is formed in a fin-shape radially outwardly extending from one of the end portions, between which the partial cylindrical surface with the edge is formed, of the rotating body positioned inside of the frame, and the detecting part is a photosensor capable of receiving the fin-shaped member.

2. A printer device comprising a rotary cutter unit as set forth in claim 1.

3. The rotary cutter unit as set forth in claim 1, wherein the one end portion of the rotating body, on which the detected part is formed, has generally a circular disk shape and is opposed to the gear for the rotating body.

4. A printing device comprising:

a frame;

a platen roller rotatably supported by the frame; and a rotary cutter unit for cutting printing paper, including:

a rotating blade extending axially as an axial blade having a rotating body, the rotating body for the rotating axial blade has end portions and a partial cylindrical surface with an edge as the axial blade formed between the end portions to accommodate forming a detected part on the rotating body for the rotating axial blade, the rotating body for the rotating axial blade positioned inside of the frame and supported by the frame in a manner rotatable about a center axis, and a detecting part for detecting the detected part;

a motor for rotating the platen roller and the rotating body; and a first transmission portion provided on one end of the center axis of the rotating body for transmitting rotating force of the motor to the rotating body, the first transmission portion positioned outside of the frame where the rotating axial blade is supported, and a second transmission portion for transmitting rotating force of the motor to the platen roller, the second transmission portion being positioned outside of the frame on a side of the frame opposite of where the first transmission portion is provided, wherein the partial cylindrical surface of the rotating body for the rotating axial blade accommodates positioning both the detected part formed on the rotating body for the rotating axial blade and the detecting part inside of the frame supporting the rotating body for the rotating axial blade, wherein the detected part is formed in a fin-shape radially outwardly extending from one of the end portions, between which the partial cylindrical surface with the edge is formed, of the rotating body positioned inside of the frame, and the detecting part is a photosensor capable of receiving the fin-shaped member.

5. The device as set forth in claim 4, wherein the one end portion of the rotating body, on which the detected part is formed, has generally a circular disk shape and is opposed to the gear for the rotating body.

6. A printing device comprising:

a frame which includes two side frames each provided at a different end of the frame, respectively;

a platen roller rotatably supported by the side frames;

a rotary cutter unit for cutting printing paper, the rotary cutter unit including:

a rotating body rotatably supported by the side frames, the rotating body including a rotating blade extending axially as an axial blade and provided on the rotating body at a position between the side frames, the rotating body for the rotating axial blade has end portions and a partial cylindrical surface with an edge for the axial blade formed between the end portions to accommodate forming a detected part on the rotating body for the rotating axial blade, an end portion of the end portions provided at one end of the rotating body positioned inside of a space between the side frames, and a transmitting member provided at the one end of the rotating body outside of one side frame, and a detecting part for detecting the detected part to determine whether the rotating axial blade is positioned at a home position, provided at a position inside of a space between the side frames;

a motor for rotating the rotating body;

a first transmission portion for transmitting rotating force of the motor to the transmitting member of the rotating body, the first transmission portion being positioned outside the one side frame; and a second transmission portion for transmitting rotating force of the motor to the platen roller, the second transmission portion being positioned outside of the other side frame different from the one side frame at which the first transmission portion is provided, wherein the partial cylindrical surface of the rotating body for the rotating axial blade accommodates positioning both the detected part formed on the rotating body for the rotating axial blade and the detecting part inside of the space between the side frames supporting the rotating body for the rotating axial blade, wherein the detected part is formed in a fin-shape radially outwardly extending from one of the end portions, between which the partial cylindrical surface with the edge is formed, of the rotating body positioned inside of the frame, and the detecting part is a photosensor capable of receiving the fin-shaped member.

* * * * *